US005463842A

United States Patent [19]

Lancaster

[11] Patent Number: 5,463,842

[45] Date of Patent: Nov. 7, 1995

[54] METHOD AND APPARATUS FOR STRETCH WRAPPING THE TOP AND SIDES OF A LOAD

[75] Inventor: William G. Lancaster, Louisville, Ky.

[73] Assignee: Lantech, Inc., Louisville, Ky.

[21] Appl. No.: 747,309

[22] Filed: Aug. 19, 1991

[51] Int. Cl.[6] ..... B65B 11/04

[52] U.S. Cl. ..... 53/399; 53/441; 53/556; 53/580; 53/587; 53/389.4

[58] Field of Search ..... 53/399, 441, 465, 53/556, 587, 588, 211, 389.2, 389.3, 389.4

[56] References Cited

U.S. PATENT DOCUMENTS

| | | | |
|---|---|---|---|
| 3,928,939 | 12/1975 | Edwards | 53/465 X |
| 4,409,776 | 10/1983 | Usui | 53/441 X |
| 4,566,253 | 1/1986 | Jones | 53/389.2 X |
| 4,706,443 | 11/1987 | Humphrey | 53/556 |
| 4,912,911 | 4/1990 | Down | 53/211 X |
| 5,040,358 | 8/1991 | Thimin | 53/556 |

FOREIGN PATENT DOCUMENTS

| | | | |
|---|---|---|---|
| 32140 | 7/1981 | European Pat. Off. | 53/556 |
| 2470055 | 6/1981 | France | 53/399 |

OTHER PUBLICATIONS

Packaging Week, Mar. 20, 1991, p. 11.

*Primary Examiner*—John Sipos
*Attorney, Agent, or Firm*—Finnegan, Henderson, Farabow, Garrett & Dunner

[57] ABSTRACT

A method and apparatus for wrapping the top and sides of a load. A web dispenser dispenses and stretches web on the direction in which it is dispensed. The load is rotated relative to the web dispenser as web is wrapped onto the load. The web dispenser is positioned in an orientation generally parallel to the sides of the load for wrapping the sides of the load, and is changed to an orientation generally parallel to the top of the load for covering the top of the load. A web supply may change orientation along with the web dispenser or may be fixed relative to the web dispenser in an orientation generally parallel to the sides of the load. When the web supply is fixed, an accumulator is provided for accumulating web. The accumulator dispenses web when the web dispenser is changing orientation and when the web dispenser is in the orientation generally parallel to the top of the load. The web supply does not provide web when the web dispenser is changing orientation or when the web dispenser is in the orientation generally parallel to the top of the load.

8 Claims, 10 Drawing Sheets

METHOD AND APPARATUS FOR STRETCH WRAPPING THE TOP AND SIDES OF A LOAD

BACKGROUND OF THE INVENTION

1. Field of the Invention

The present invention relates to a packaging apparatus and method for covering the top and sides of a load in a stretch wrapping operation.

2. Description of the Related Art

Stretch wrapping is a packaging technique in which a web of film is dispensed from a film roll. The web is stretched and wrapped around the sides of the load to secure, cover and protect the load. It is well known in the art to support and maneuver the film roll either manually or mechanically. In wrapping the sides of the load, film rolls having a width equal to the height of the load can be used to cover the sides of the load without the need to vertically maneuver the film roll. Alternatively, a lesser width film roll can be vertically maneuvered to spirally wrap the film around the sides of the load, thus covering the sides of the load. In some instances, the top edge of the film is allowed to extend over the top edge of the load and rest on a portion of the top of the load to help secure the load. In other instances the film roll is maneuvered manually over the top of the load to dispense the film web over a portion of the top of the load to tie down and secure the load.

For some applications, it is desirable to cover not only the sides of the load, but also to cover the top of the load as well, to protect the load from the adverse effects of water, dirt, dust, and weather. In one known method, the top of the load is covered by dispensing a film web from a first film roll and wrapping that film web about the sides of the load to secure the load. A cover sheet is then dispensed from a second film roll and placed over the top of the load with the edges of the cover sheet hanging over the sides of the load. Additional film web is then dispensed from the first roll and wrapped around the sides of the load to maintain the cover sheet in position and further secure the load.

SUMMARY OF THE INVENTION

It is an object of the present invention to provide a stretch wrapping device which can automatically wrap the top and sides of a load in an effective and efficient manner.

Additional objects and advantages of the invention will be set forth in part in the description which follows, and in part will be obvious from the description, or may be learned by practice of the invention. The objects and advantages of the invention will be realized and obtained by means of the elements and combinations particularly pointed out in the appended claims.

To achieve the foregoing objects and in accordance with the purpose of the invention, as embodied and broadly described herein, the invention includes dispensing a web from a web dispenser, stretching the web along the dispensing direction, and wrapping the web around the sides of the load by rotating the load relative to the web dispenser while maintaining the web dispenser and web being dispensed in an orientation generally parallel to the sides of the load. The top of the load is covered with the web by repeated steps of raising the web dispenser above the load, positioning the web dispenser and web in an orientation generally parallel to the top of the load, dispensing web to cover a portion of the top of the load with the web, lowering the web dispenser relative to the load, and positioning the web dispenser and web being dispensed in an orientation generally parallel to the sides of the load, while rotating the load relative to the web dispenser. This arrangement allows a single web supply and web dispenser to cover the top and sides of the load.

The present invention also comprises an accumulator for accumulating the web when the web dispenser is in the orientation generally parallel to the sides of the load, and for dispensing web when the web dispenser is changing orientation and is in the orientation generally parallel to the top of the load. The accumulator allows the web dispenser to change orientation while the film web is supplied from a web supply without the film web bunching or binding.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate presently preferred embodiments of the method and apparatus of the invention and, together with the general description given above and the detailed description of the preferred embodiments given below, serve to explain the principles of the invention.

DESCRIPTION OF THE PREFERRED EMBODIMENTS

Reference will now be made in detail to the presently preferred embodiments and methods of the invention, examples of which are illustrated in the accompanying drawings.

According to one aspect of the present invention, the apparatus includes a web dispenser for dispensing a web and stretching the web along the dispensing direction. Means are provided for positioning the web dispenser and alternating the position of the web dispenser and the web between an orientation generally parallel to the sides of the load in a lowered position for wrapping the sides of the load, and an orientation generally parallel to the top of the load in a raised position for wrapping the web on the top of the load. Means are provided for rotating the load relative to the web dispenser.

Figure 16:
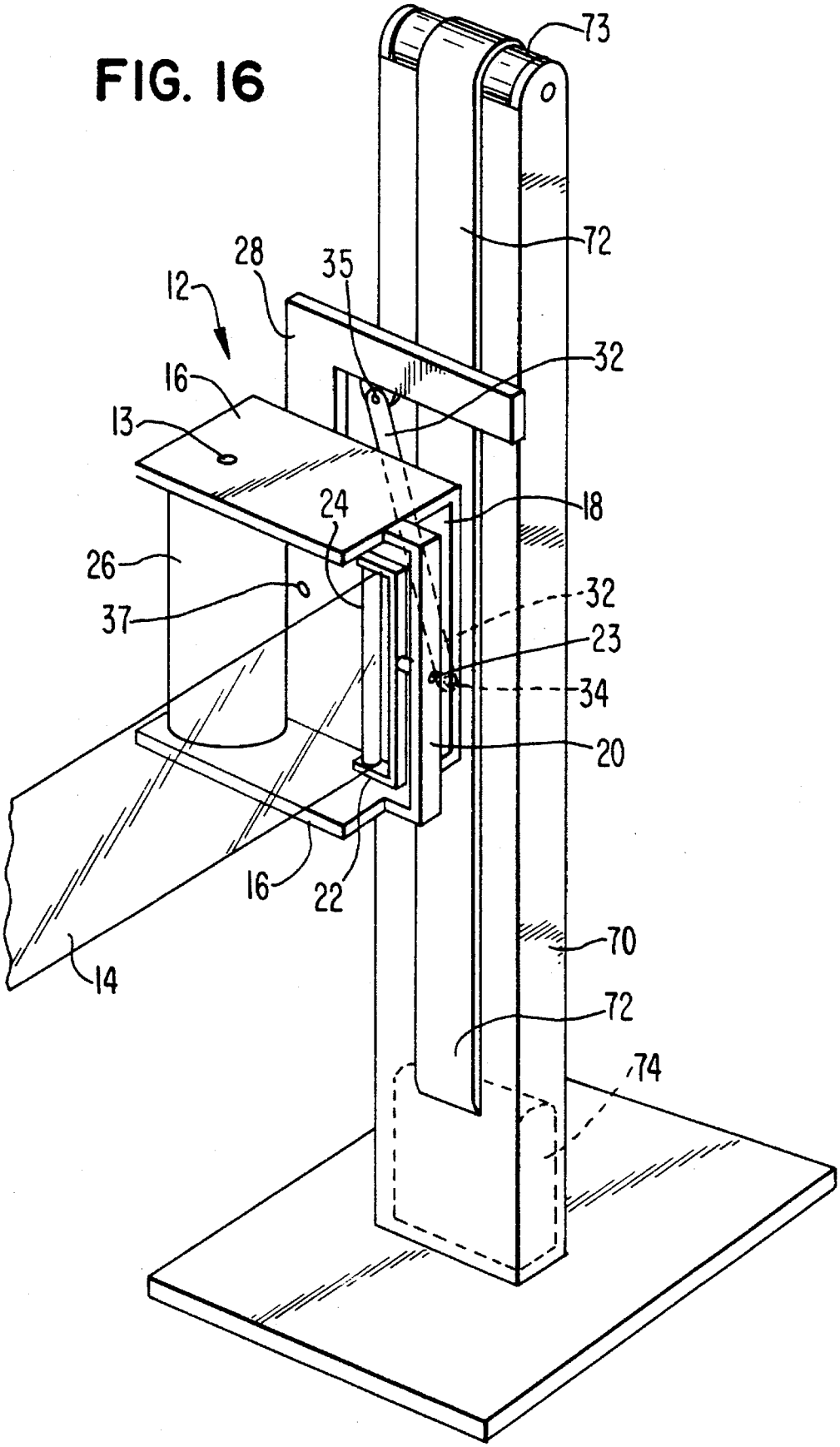
FIG. 16 is a perspective view of a portion of the first embodiment of the invention.

As shown in FIG. 16, web dispenser 12 dispenses web 14 of stretch wrap material from film roll 26. Web dispenser 12 includes a frame having end plates 16, back plate 18, and a bar 20. Web dispenser 12 also includes a clevis 22 rotatably connected to the middle of bar 20 by pivotal connection 23, and guide roller 24 rotatably mounted on clevis 22. A film roll 26 is mounted on a braked spindle 13 which is supported by end plates 16. Spindle 13 permits film roll 26 to rotate while braking its motion to restrain and stretch web 14 as it is dispensed.

Alternatively, the web may be stretched by a braked roller, or upstream and downstream prestretch rollers which are coupled together so that the downstream prestretch roller rotates at a greater speed than the upstream prestretch roller and thereby stretches the web in the dispensing direction. An example of such a film stretching mechanism is shown in U.S. Pat. No. 4,302,920, which is incorporated herein by reference.

In accordance with the invention, means are provided for positioning the web dispenser. The means for positioning the web dispenser preferably includes a control system having a programmable logic controller such as that shown in FIG. 17 and discussed below. As shown in FIG. 16, the positioning means also includes a mechanism for moving the web dispenser in accordance with the commands of the control system. The mechanism may be hydraulic, pneumatic, electromechanical or similar types of motive systems. As shown, the mechanism includes a fluid cylinder 32. One end of fluid cylinder 32 is rotatably attached to back plate 18 of web dispenser 12 at pivot 34. The other end of fluid cylinder 32 is rotatably attached to frame 28 at pivot 35. Selective activation of fluid cylinder 32 causes the web dispenser 12 to rotate relative to frame 28 about the pivot 37. Frame 28 is slidably mounted on mast 70 to be vertically positioned by belt 72 which is driven over roller 73 by motor 74.

Figure 13:
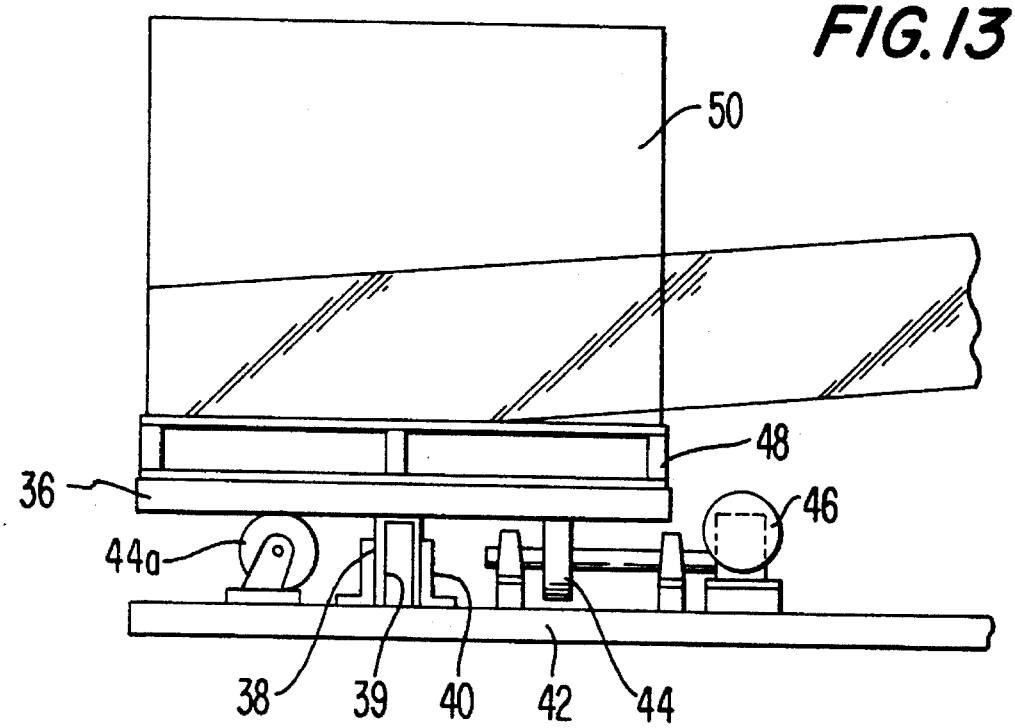
FIG. 13 is a side view of an embodiment of the turnable assembly of the present invention.

In accordance with the invention and as shown in FIG. 13, means are provided for rotating load 50 relative to web dispenser 12 whereby load 50 on pallet 48 is wrapped with web 14. As embodied herein, the means for rotating the load includes turntable platform 36, vertical axle 38, bearing 40, base 42, drive wheel 44, and motor with geared speed reducer 46. Platform 36 is supported by drive wheel 44 and casters 44a, and pivoted on vertical axle 38 which is journalled on bearing 40 affixed to base 42. Motor 46 powers drive wheel 44, which rotates platform 36. The means for rotating load relative to the web dispenser may alternatively include an arrangement for moving the web dispenser around a stationary load.

A leading end of web 14 is attached to load 50 or a clamp on turntable 36. As platform 36 and load 50 is rotated about a vertical axis, relative to web dispenser 12, web 14 is dispensed, stretched and wrapped around the load.

Figure 1:
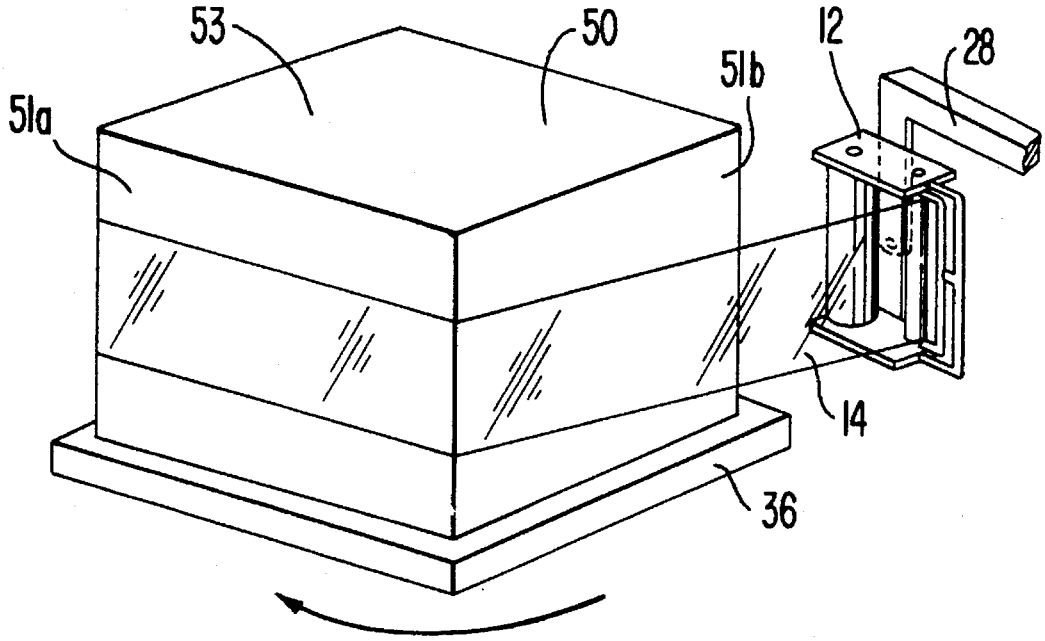
FIGS. 1–5 are perspective schematic views of a first embodiment of the present invention shown in successive stages of wrapping a load.
Figure 2:
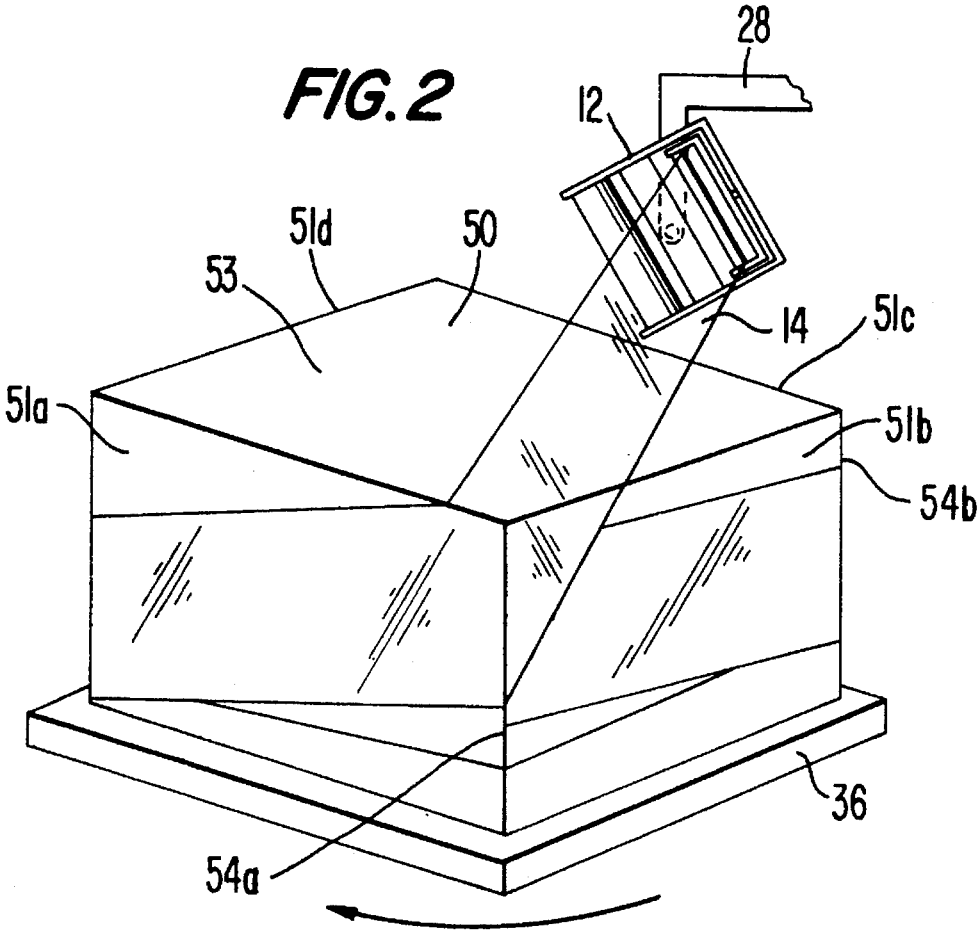

As shown in FIG. 1, web 14 is dispensed along vertical sides 51 of load 50 while web dispenser 12 and web 14 is maintained in a vertical orientation generally parallel with sides 51. Sides 51 are spirally wrapped by moving dispenser 12 in the vertical direction while rotating load 50. After sides 51 are wrapped, a sequence is started to wrap the top 53 of load 50.

As shown in the sequence of FIGS. 2, 3, 4, 5, just after web 14 passes a corner 54a of the load 50, dispenser 12 is raised above the top of load 50 by driving belt 72 with motor 74. Simultaneously, fluid cylinder 32 is actuated to change the orientation of web dispenser 12 from a vertical orientation generally parallel with sides 51 to a horizontal orientation generally parallel with top 53 of load 50.

As web dispenser 12 is raised, a portion of web 14 engages the corner 54*a* of the load between the side 51*a* and side 51*b* of load 50. Web dispenser 12 continues to be raised and rotated until it is above the top 53 of the load 50 and in a horizontal orientation generally parallel to the top 53 of the load 50. Web dispenser 12 is maintained in this horizontal orientation while load 50 continues to rotate, causing the web 14 to overlie a portion of top 53 of load 50 and engage the top edge of side 51*b*.

Figure 3:
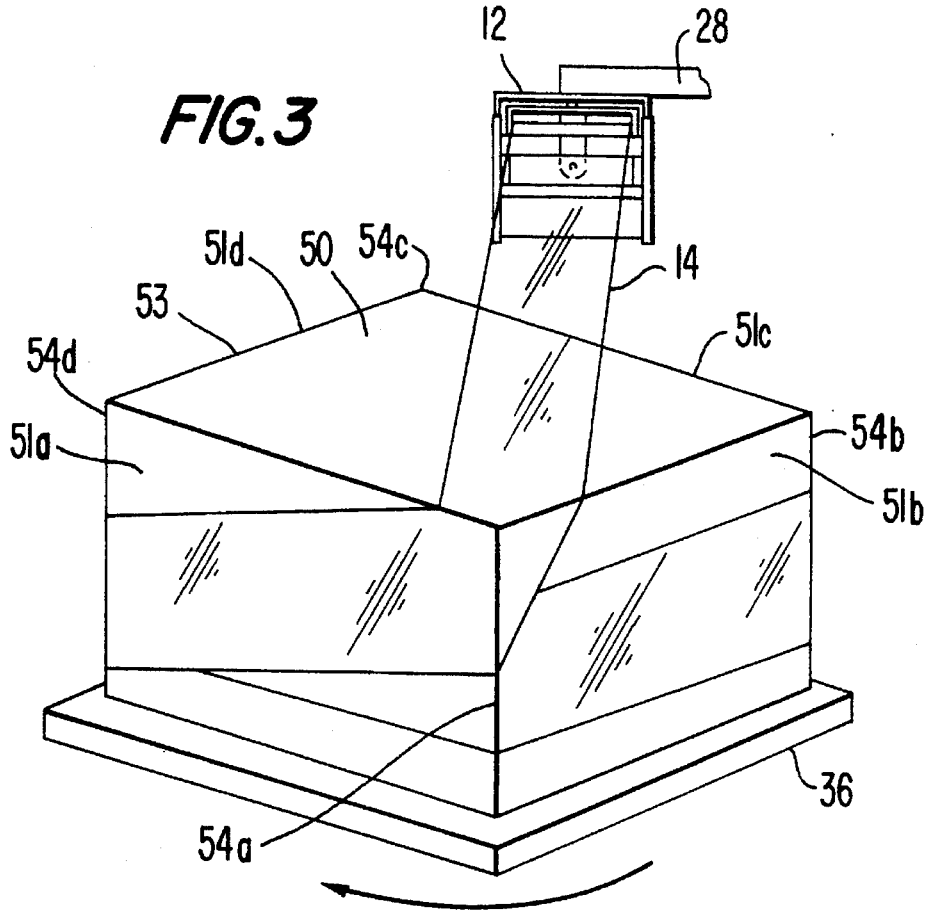
Figure 5:
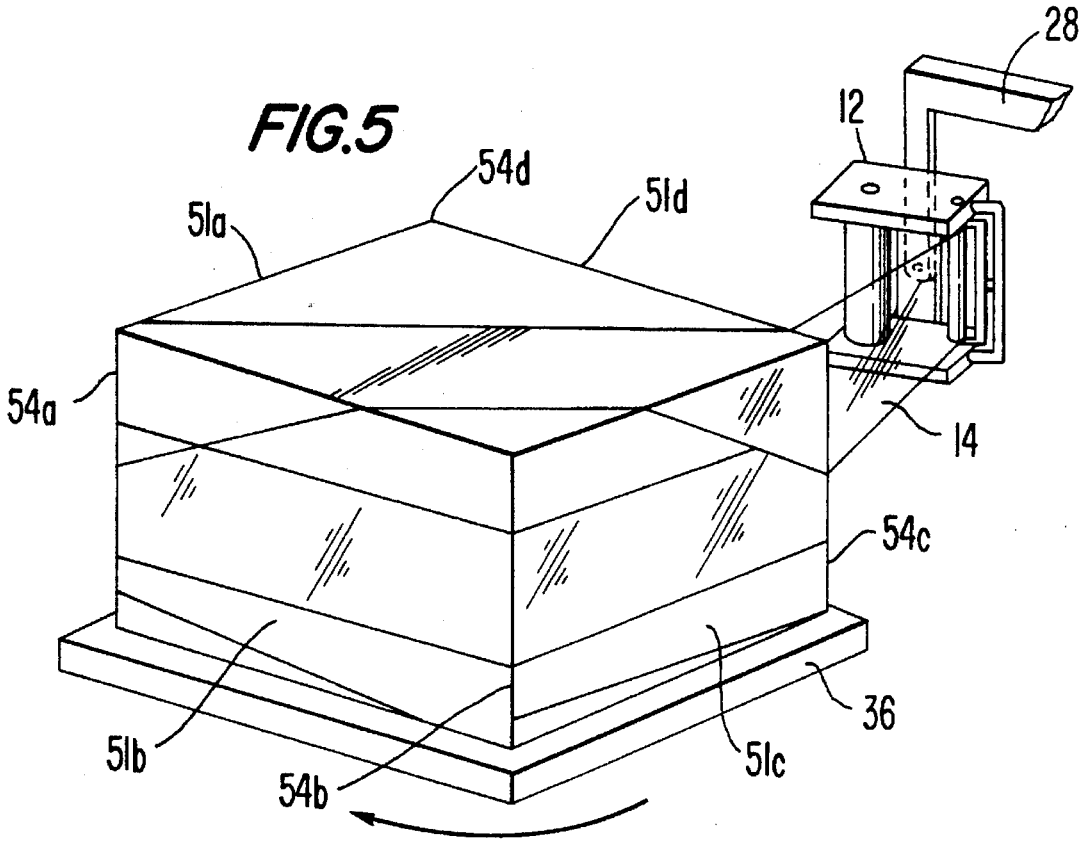
Figure 4:
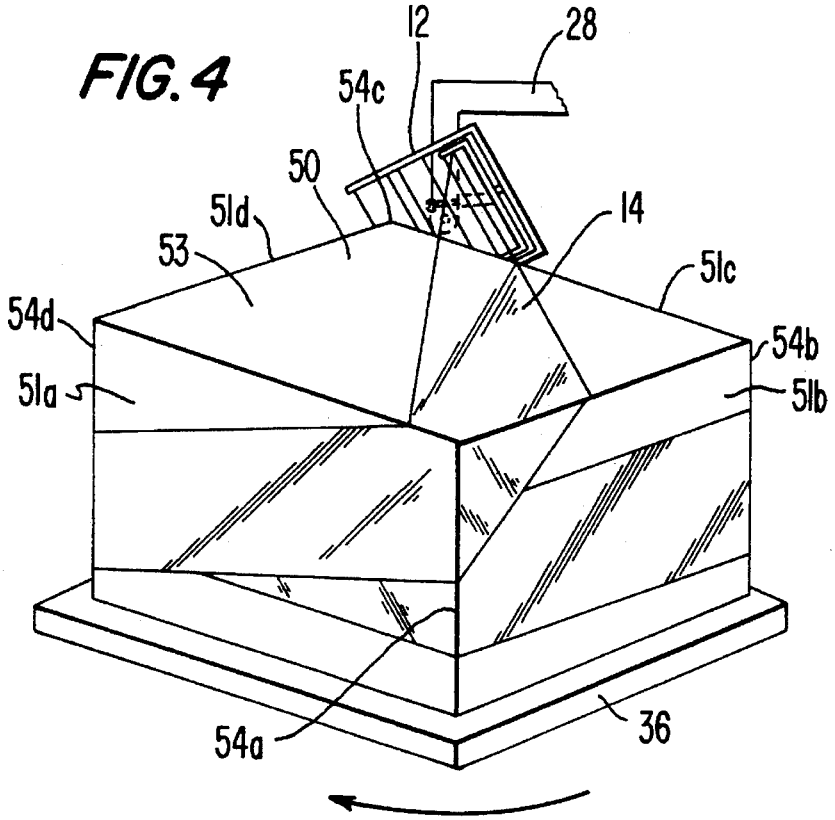

As shown in the sequence of FIGS. 3, 4, 5, dispenser 12 is lowered below the top 53 of load 50 after web 14 passes second corner 54*b* and before it passes third corner 54*c* so that web 14 engages the top edge of side 51*c*. Preferably, at the end of the lowering operation, fluid cylinder 32 is actuated to change the orientation of web dispenser 12 from a horizontal orientation generally parallel to the top 53 of load 50 to a vertical orientation generally parallel to the sides 51 of the load as load 50 continues to rotate, leaving a flat piece of web covering a portion of top 53 of load 50 between top edges of sides 51*b* and 51*c*.

Figure 15:
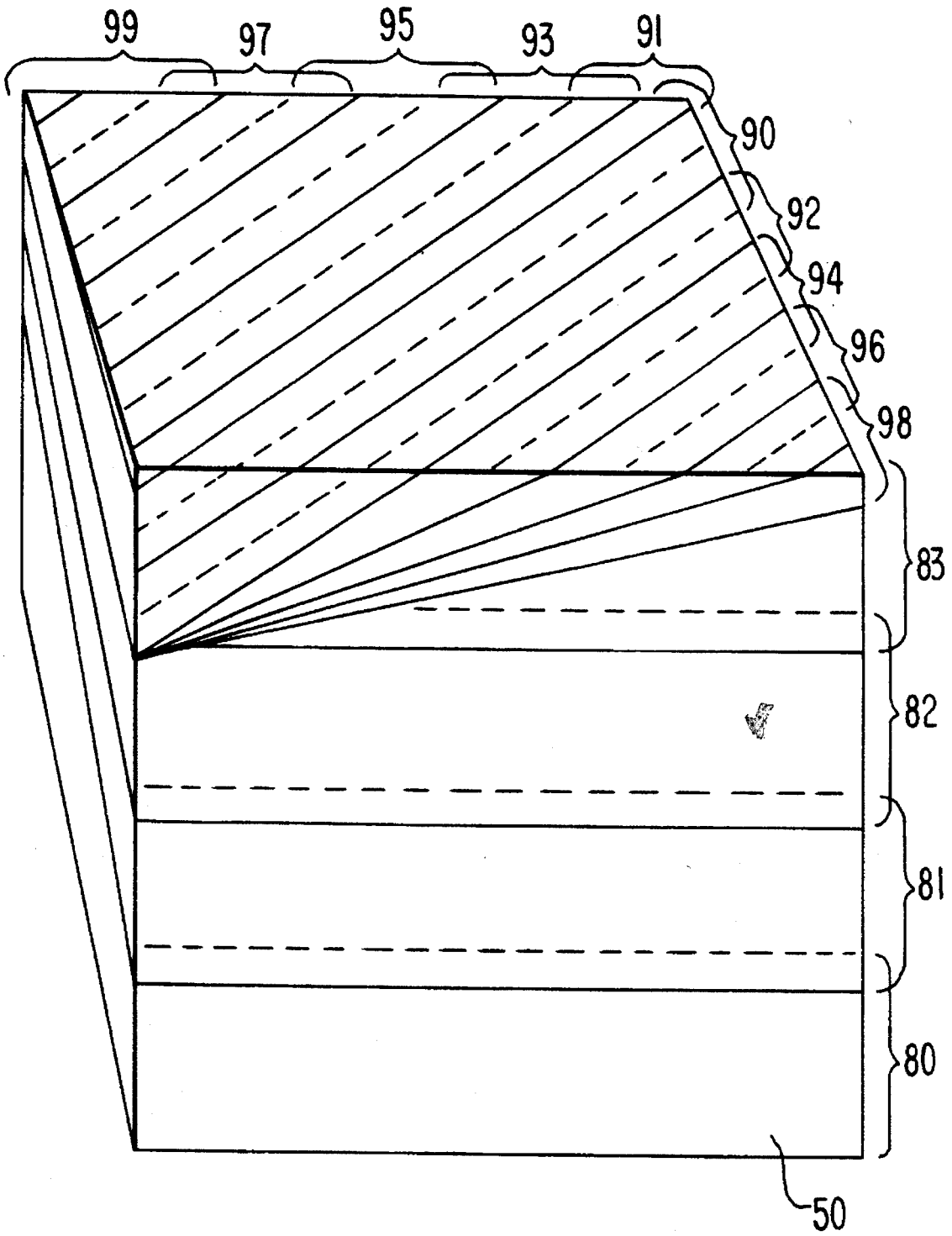
FIG. 15 is a perspective view of a covered load.

As shown in FIG. 5, when web dispenser 12 is lowered below the top 53 of load 50 and is in a vertical orientation generally parallel to the sides of the load, web 14 is then wrapped around corner 54*c* of load 50 which is diametrically opposite corner 54*a*. The sequence shown in FIGS. 2–5 is then repeated to position a flat piece of web covering a portion of top 53 of load between top edge of sides 51*d* and 51*a*. The whole procedure continues to be repeated, covering adjacent portions of top 53 of the load, until the entire top 53 is covered with partially overlapping areas of web as shown in FIG. 15.

The drawings show repeatedly alternating the position of web dispenser 12 during the raising and lowering steps in which the top of the load is covered. However, it is also within the scope of the invention to leave web dispenser 12 in the horizontal orientation during the repeated series of steps executed while covering the top of the load, and position web dispenser 12 in the vertical orientation only when covering the sides of the load.

A second embodiment of the present invention is shown in FIGS. 6–12 to illustrate another aspect of the invention. According to this aspect of the invention, an accumulator is provided for accumulating the web when the web dispenser is in an orientation generally parallel to the sides of the load. The accumulator is capable of releasing the accumulated web when the web dispenser is changing orientation and in an orientation generally parallel to the top of the load.

In this arrangement, the film roll 126 and the frame 127 supporting film roll 126 do not change orientation when web dispenser 112 is rotated. The axis of film roll 126 is maintained in a vertical orientation generally parallel to sides 51 of load 50 throughout the wrapping operation.

The frame 127 supporting film roll 126 may be integral with frame 128 supporting web dispenser 112 and vertically positionable along with frame 128. Alternatively, the frame for supporting the film roll may be completely stationary so that when frame 128 is vertically positioned by a motorized belt transport (similar to 72 and 74 of FIG. 16), frame 128 and web dispenser 112 is moved relative to frame 127 and film roll 126.

Figure 12:
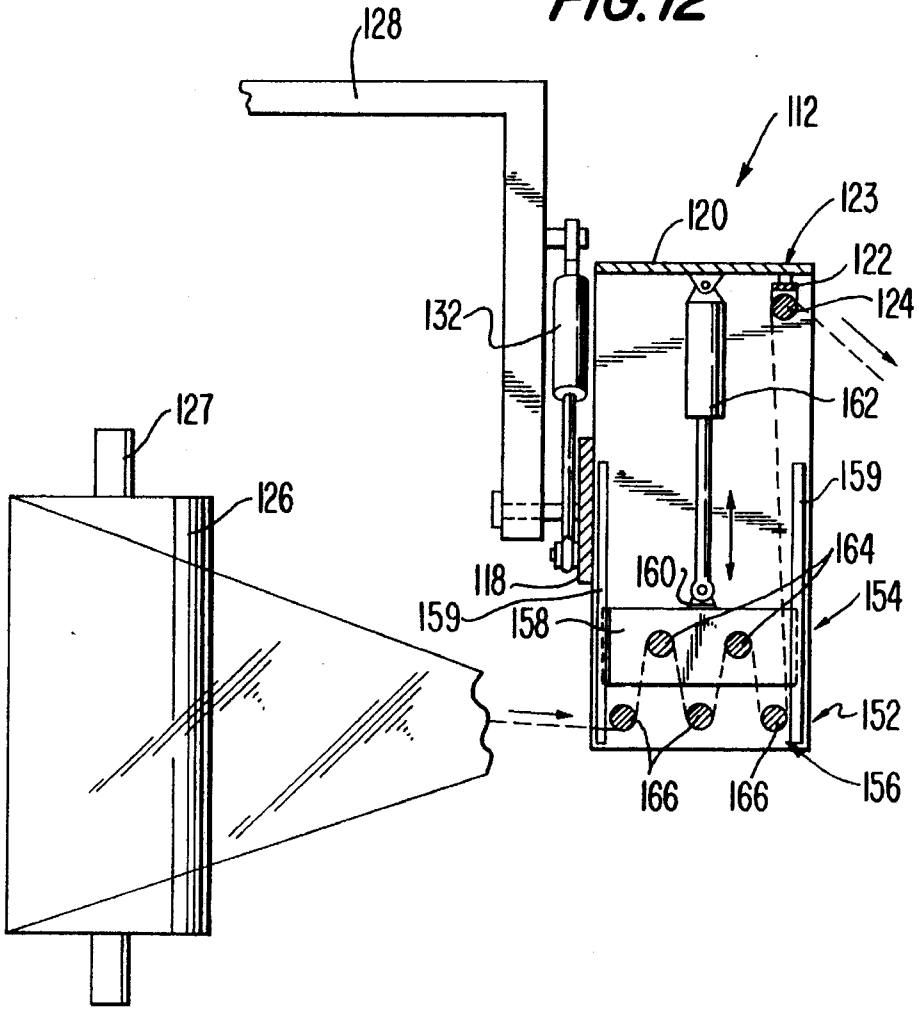
FIG. 12 is a sectional view of the web dispenser of FIG. 11.
Figure 11:
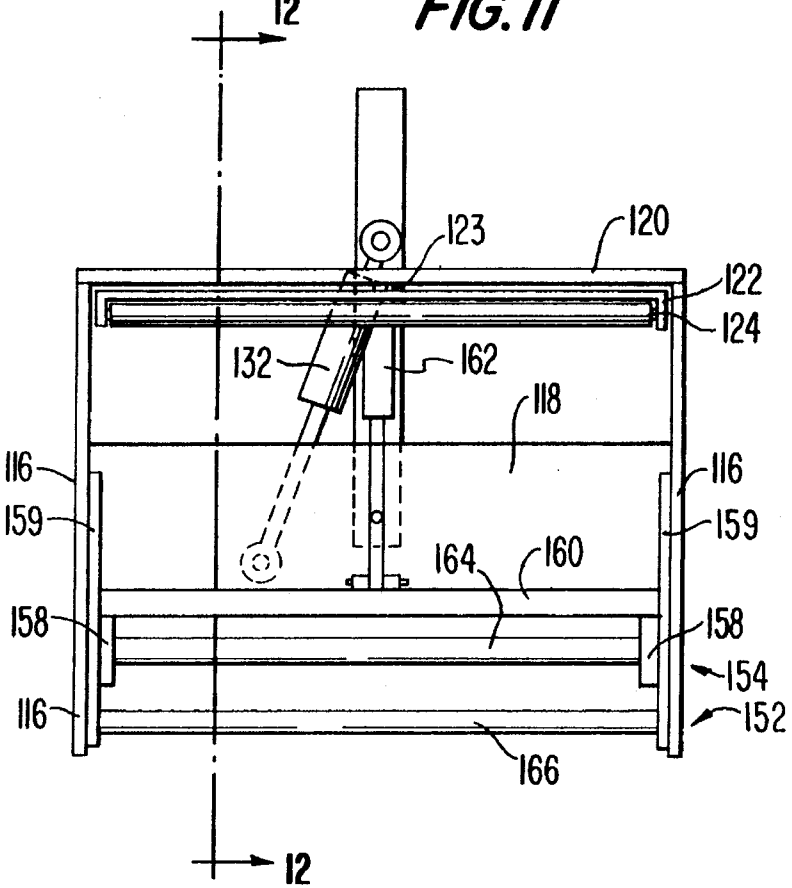
FIG. 11 is a side view of the web dispenser of the second embodiment of the present invention.

As shown in FIGS. 11 and 12, the web dispenser 112 includes a frame having end plates 116, back plate 118 connecting end plates 116, a bar 120, clevis 122 rotatably connected to bar 120 by pivotal connection 123, guide roller 124 rotatably mounted on clevis 122.

In accordance with the invention, an accumulator 152 is provided for accumulating web 14. As embodied in FIGS. 11 and 12, accumulator 152 includes first web guide 156 and second web guide 154. First web guide 156 comprises a first plurality of rollers 166. Each of the first plurality of rollers 166 is rotatably mounted to end plates 116 of web dispenser 112. Second web guide 154 comprises a second plurality of rollers 164, each of which is rotatably mounted to movable plates 158 which are connected by bar 160. Plates 158 slide in grooves defined by bars 159. One end of fluid cylinder 162 is connected to 120, and the other end of fluid cylinder is connected to bar 160. Actuation of fluid cylinder 162 moves first web guide 154 and second web guide 156 away from each other to accumulate film. The release of pressure on fluid cylinder 162 allows the film web to pull the web guides toward each other and thereby dispense the accumulated film.

Figure 14:
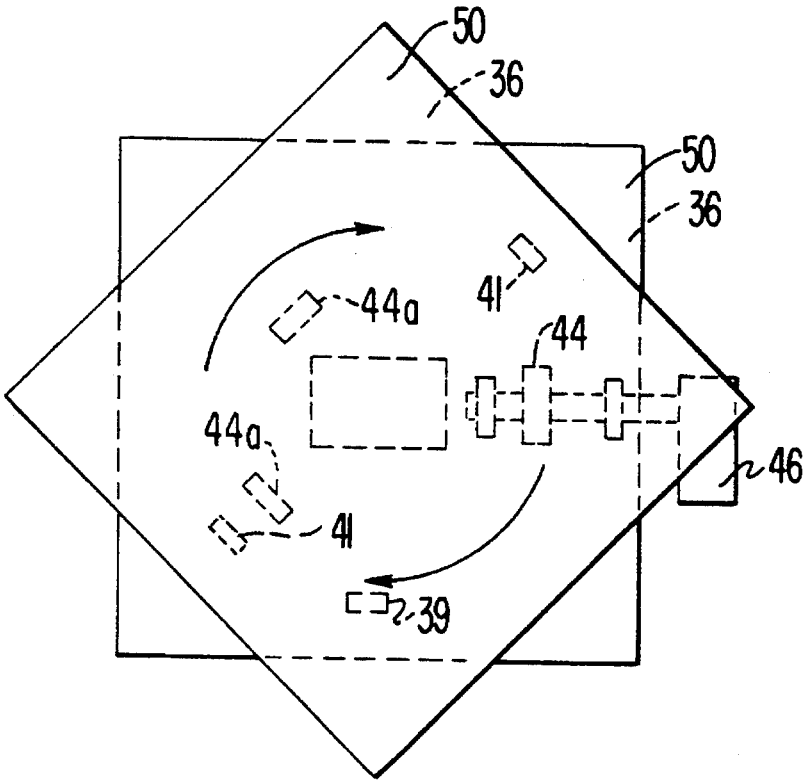
FIG. 14 is a plan view of the turntable assembly of FIG. 13.

The means for positioning the web dispenser 112 and the means for rotating the load 150 are substantially similar to those described above and shown in the embodiment illustrated in FIGS. 13, 14 and 16. Similar numerals are used in FIGS. 11 and 12 to indicate parts similar to those shown in the embodiment of FIGS. 13, 14 and 16 which are not discussed in detail.

The method of wrapping load 150 is shown in FIGS. 6–10. Load 150 is placed on platform 36. Web 114 is passed through the first plurality of rollers 166 and the second plurality of rollers 164 in an undulating pattern shown in FIG. 12. The loading end of web 114 is then attached to load 150.

Platform 136 is rotated about a vertical axis to rotate load 150 relative to web dispenser 112. The rotation of load 150 pulls web 114 out of web dispenser 112. The web 114 is stretched and wrapped around sides 151 of load 150 while web dispenser 112 and web 114 are in a vertical orientation generally parallel to the sides 151 of load 150. Fluid cylinder 162 is actuated to increase the distance between first guiding means 156 and second guiding means 154 when web dispenser 112 and web 114 are in a vertical orientation generally parallel to the sides of the load to accumulate web within the accumulator 152. Sides 151 are spirally wrapped by moving dispenser 112 in the vertical direction while rotating load 150.

Figure 6:
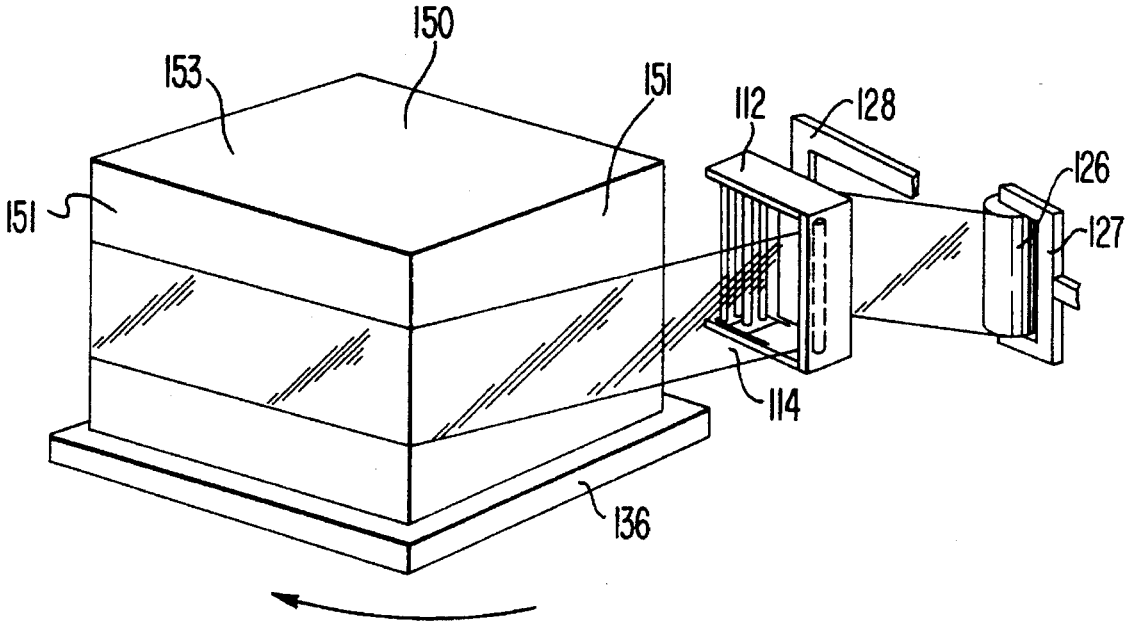
FIGS. 6–10 are perspective schematic views of a second embodiment of the present invention shown in successive stages of wrapping a load.
Figure 7:
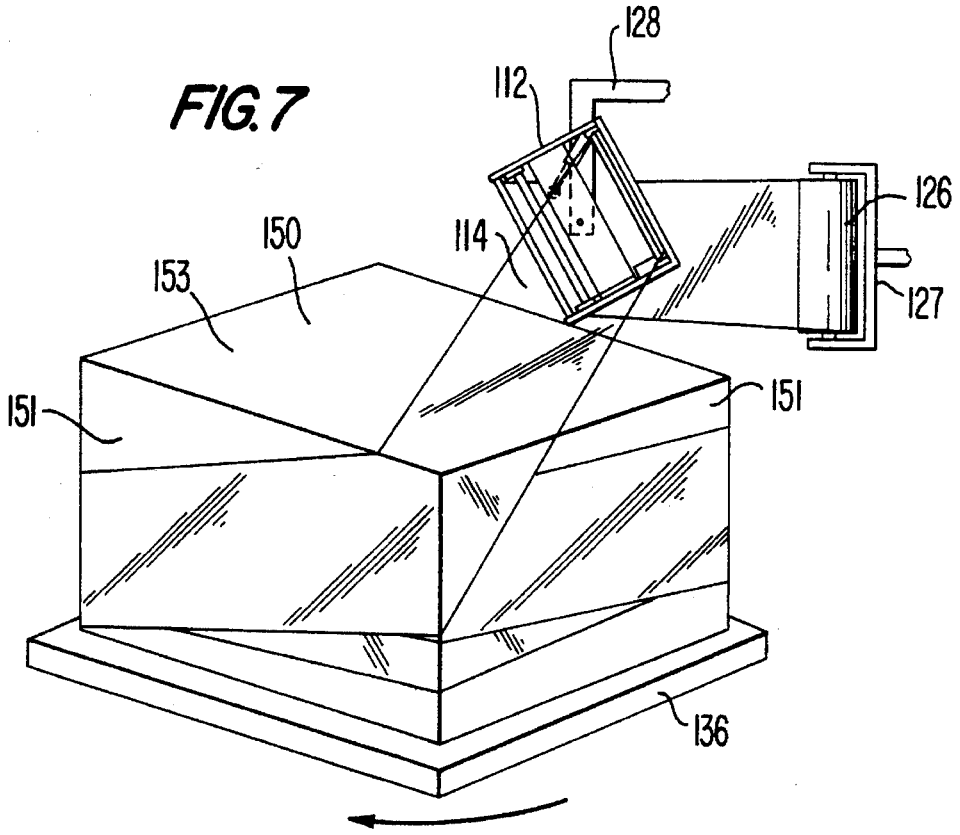
Figure 8:
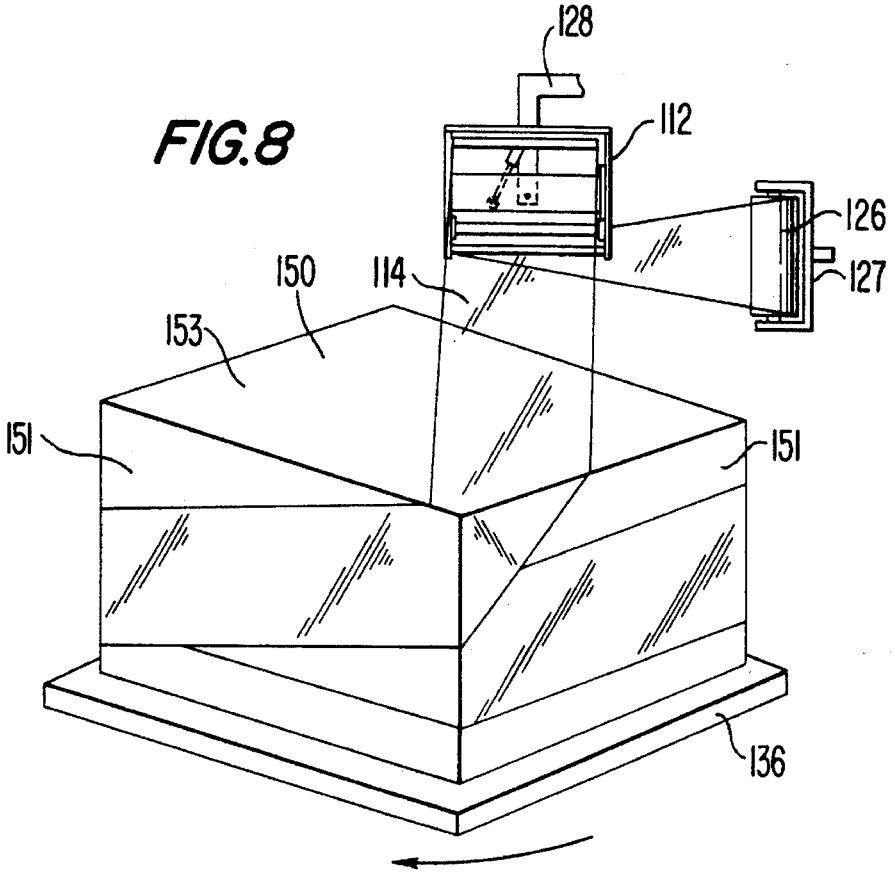
Figure 9:
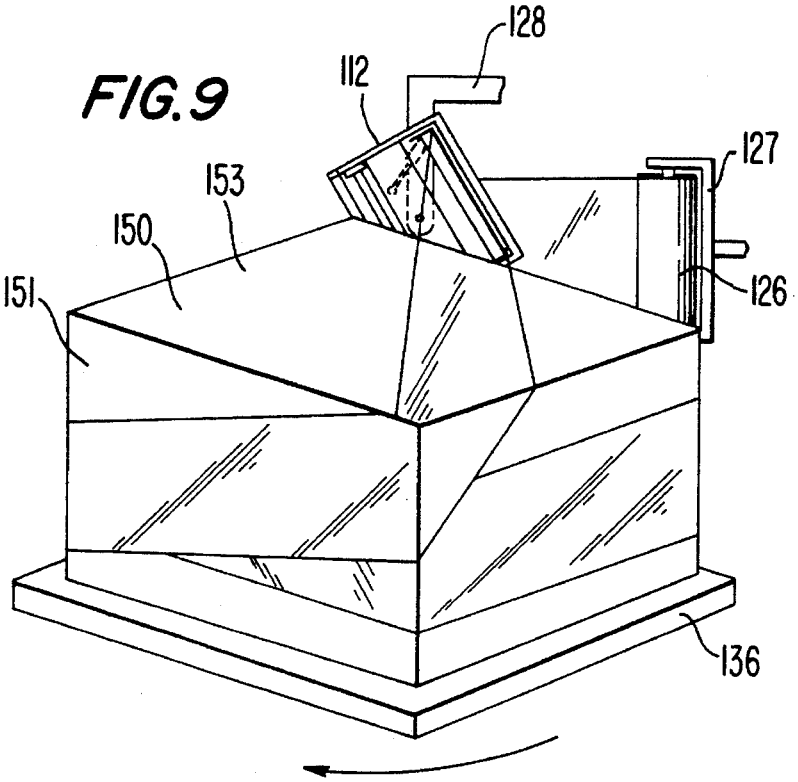
Figure 10:
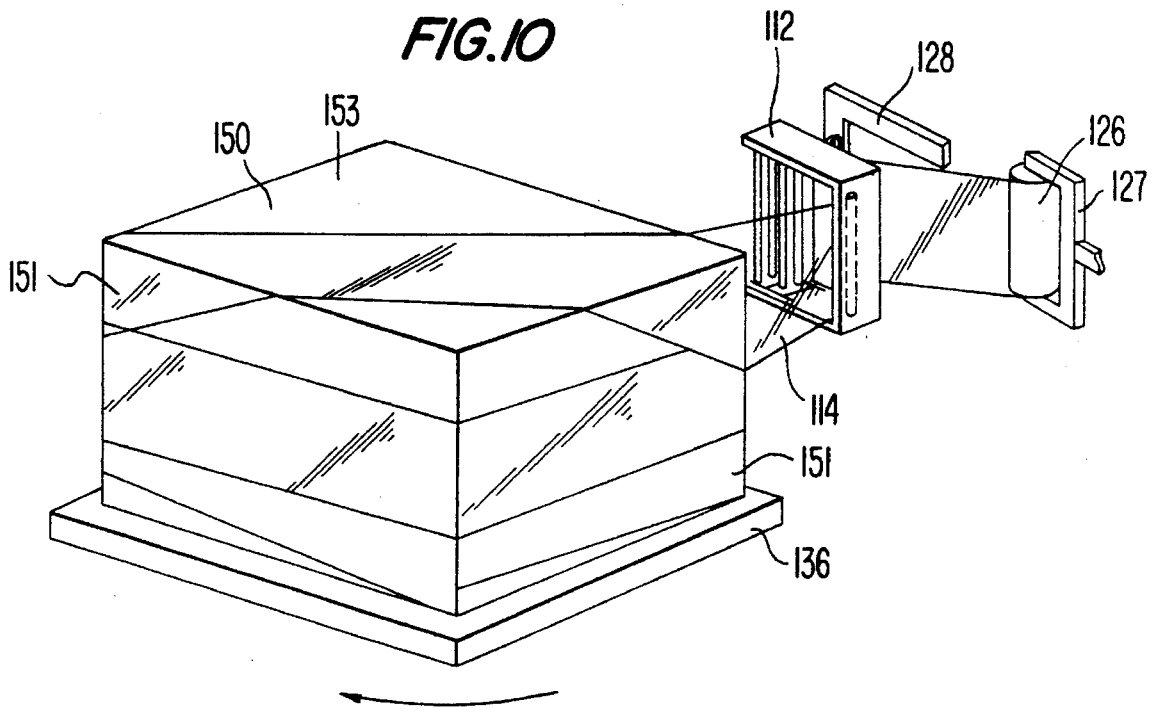

As shown in the sequence of FIGS. 6, 7, 8, dispenser 112 is raised above the top of load 150 while fluid cylinders 132 and 162 are simultaneously actuated. Fluid cylinder 132 is actuated to change the orientation of web dispenser 112 from a vertical orientation generally parallel to the sides of the load to a horizontal orientation generally parallel with top 153 of load 150.

The pressure on the fluid cylinder 162 is released to allow the first web guide 156 and second web guide 154 to be drawn closer to each other as web dispenser 112 begins to change orientation. As the distance lessens between the first and second web guide 154 and 156, accumulator 152 will begin to dispense web previously accumulated between rollers 164 and 166. As web dispenser 112 changes orientation and moves into an orientation generally parallel to the top of the load, web is no longer fed from web supply 126 to web dispenser 112. When web dispenser 112 is not in an orientation generally parallel to the sides of the load, web which is dispensed onto the load is not taken from web supply 126, but rather from accumulator 152. This prevents binding and bunching of web in web dispenser 112, which otherwise would occur when rotating web dispenser 112 relative to the film roll 126.

Web dispenser 112 is raised and rotated until it is in a horizontal orientation generally parallel to the top of the load. Web dispenser 112 is maintained in this orientation while the load continues to rotate, whereby web 114 will overlie a portion of top 153 of load 150. While web 114 is overlying a portion of the top of the load 50, the web dispenser 112 is lowered. Simultaneous with the lowering operation, fluid cylinder 132 is operated to change the orientation of web dispenser 112 from a horizontal orientation generally parallel to top 153 of load 150 to a vertical orientation generally parallel to the sides 151 of load 150.

The stroke of cylinder 162 is timed to extend over the period from when dispenser 112 begins to rotate away from its vertical orientation, until its return to its vertical orientation after dispensing web over a portion of the top 152 of load 150. As a result, rollers 164 and 166 proceed toward each other during this period when dispenser 112 is not in a vertical orientation, dispensing the film web accumulated between rollers 164 and 166 and eliminating the need to draw film web from film roll 126 during this period.

After dispenser 112 returns to a vertical orientation, the distance between rollers 164 and 166 is increased by actuating fluid cylinder 162, thereby increasing the amount of web 114 contained in accumulator 152 for use in the next iteration. Once dispenser 112 is in a vertical orientation, and accumulator 152 begins accumulating film web, film web is once again drawn from film roll 126, which has the same vertical orientation as the web dispenser when the web dispenser is in the vertical orientation.

The top of the load may be covered by initially covering a central portion of the top of the load and working outward, by covering the outward portions of the top of the load and working inward, or by working outward on one area and inward on another area of the top, or by other patterns and routines.

In the arrangement shown in FIG. 15, the sides and top of load 50 are shown covered with a single web. The sides were first wrapped with overlapping layers 80–83. The web dispenser was then lifted above the plane of the top of the load at opposing corners of the load to cover the top of the load. A central portion of the top of the load was covered initially and then portions located outwardly from the central portion were progressively covered by overlapping layers of web. First portion 90 of the top is covered, then second portion 91, followed by third portion 92. The routine continues, covering portions 93–99 in sequential order, until the top of the load is covered.

Figure 17:
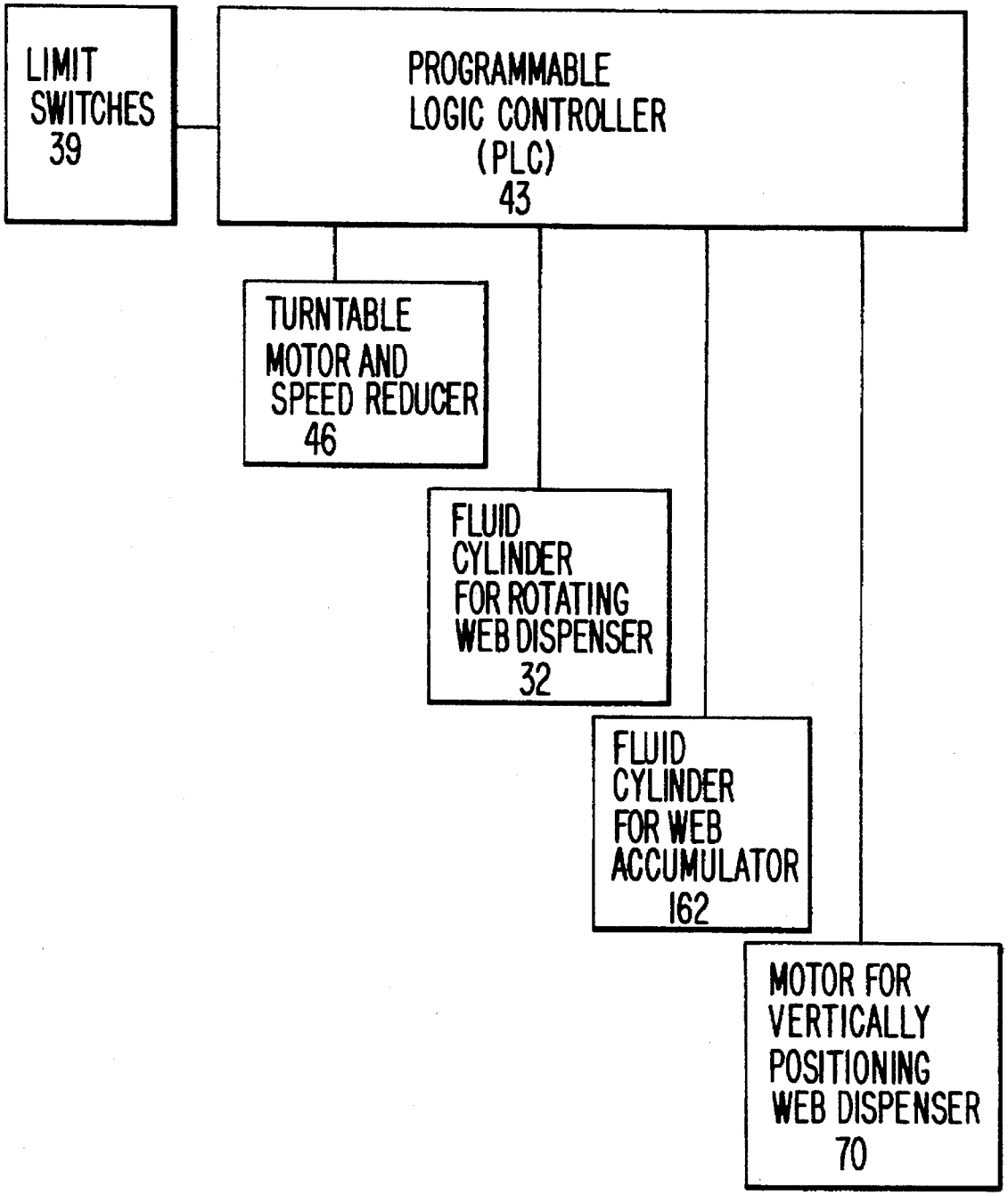
FIG. 17 is a control diagram according to the present invention.

As shown in FIG. 17, the mechanism for controlling the position of the web dispenser preferably includes but is not limited to a control system having a programmable logic controller (PLC) 43 such as those made by Allen-Bradley. As shown in FIGS. 13 and 14, sensors, such as magnetic proximity limit switch 39, can be mounted on base 42. Blocks of steel 41, which can be sensed by limit switch 39, and mounted underneath turntable platform 36. Limit switch 39 supplies load and turntable position information to PLC 43 which in turn controls motor 46, motor 70, fluid cylinder 32 and, in the second embodiment, fluid cylinder 162. Preferably, the PLC uses an additive time function to position the web in an overlapped arrangement on different adjoining portions of the top of the load during each subsequent revolution of the load as shown in FIG. 15.

It will be apparent to those skilled in the art that various modifications and variations can be made in the practice of the present invention without departing from the scope or spirit of the invention.

Additional advantages and modifications will readily occur to those skilled in the art from consideration of the specification and practice of the invention disclosed herein. Therefore, the invention in its broader aspects is not limited to the specific details, representative devices, and illustrative examples shown and described. It is intended that the specification and examples be considered as exemplary only, with the true scope and spirit of the general inventive concept being defined by the appended claims and their equivalents.

What is claimed is:

1. A method of stretch wrapping the sides and top of a load, compromising the steps:

dispensing a web from a web dispenser, stretching the web along the dispensing direction, and wrapping the web around the sides of the load by rotating the load relative to the web dispenser while maintaining the web dispenser and web being dispensed in an orientation generally parallel to said sides of the load;

covering the top of the load with the web by rotating the load relative to the web dispenser and positioning the web dispenser and web being dispensed in an orientation generally parallel to the top of the load, and repeatedly performing the steps of raising the web dispenser above the load, dispensing the web to cover a portion of the top of the load with the web, and lowering the web dispenser relative to the load to catch the web on the sides of the load, to sequentially cover portions of the top of the load until the top of the load is covered; and accumulating web in the web dispenser from a web supply when the web dispenser is in the orientation generally parallel to said sides of the load and releasing the accumulated web from the web dispenser without receiving web in the web dispenser from the web supply when the web dispenser is in an orientation other than the orientation generally parallel to the sides of the load.

2. A method of stretch wrapping the sides and top of a load, comprising the steps of:

dispensing a web from a web dispenser, stretching the web along the dispensing direction, and wrapping the web around the sides of the load by rotating the load relative to the web dispenser while maintaining the web dispenser and web being dispensed in an orientation generally parallel to said sides of the load;

covering the top of the load with the web by rotating the load relative to the web dispenser and repeatedly performing the steps of raising the web dispenser above the load, positioning the web dispenser and web being dispensed in an orientation generally parallel to the top of the load, dispensing the web to cover a portion of the top of the load with the web, and lowering the web dispenser relative to the load and positioning the web dispenser and web being dispensed in the orientation generally parallel to the sides of the load to catch the web on the sides of the load, to sequentially cover portions of the top of the load until the top of the load is covered; and accumulating web in the web dispenser from a web supply when the web dispenser is in the orientation generally parallel to said sides of the load and releasing the accumulated web from the web dispenser without receiving web in the web dispenser from the web supply when the web dispenser is in an orientation other than the orientation generally parallel to the sides of the load.

3. The method of claim 1 or 2 wherein the accumulating step includes passing the web through a first web guide and a second web guide, increasing the distance between the first and second web guides to accumulate web, and decreasing the distance between the first and second web guides to dispense accumulated web.

4. An apparatus for stretch wrapping the sides and top of a load, comprising:

a web dispenser for dispensing and stretching a web along the dispensing direction;

means for rotating the load relative to the web dispenser;

means for positioning the web dispenser and alternating the position of the web dispenser and the web being dispensed between an orientation generally parallel to said sides of the load in a lowered position for wrapping the sides of the load and an orientation generally parallel to said top of the load in a raised position for covering the top of the load;

control system for repeatedly raising the web dispenser above the load, dispensing the web to cover a portion of the top of the load with the web, and lowering the web dispenser relative to the load to catch the web on the sides of the load, to sequentially cover portions of the top of the load until the top of the load is covered; and wherein the web dispenser includes an accumulator for accumulating web in the web dispenser from a web supply when the web dispenser is in the orientation generally parallel to said sides of the load, and for releasing the accumulated web from the web dispenser without receiving web in the web dispenser from the web supply when the web dispenser is in an orientation other than the orientation generally parallel to the sides of the load.

5. The apparatus of claim 4 wherein the accumulator includes a first web guide and a second web guide, and means for increasing the distance between the first and second web guide to accumulate web and for decreasing the distance between the first and second web guide to decrease the amount of web accumulated in the accumulator and dispense the accumulated web.

6. The apparatus of claim 5 wherein the first web guide includes at least one roller and the second web guide includes at least one roller.

7. The apparatus of claim 5 wherein the first web guide includes a first series of rollers and the second web guide includes a second series of rollers defining an undulating film path.

8. The apparatus of claim 4 including a support for a web supply for providing web to the web dispenser, the support maintaining the web supply and the web between the web supply and the web dispenser in an orientation generally parallel to said sides of the load when the web dispenser is in the orientation parallel to the sides of the load and maintaining the web supply in an orientation generally parallel to the sides of the load when the web dispenser is in an orientation generally parallel to the top of the load.

* * * * *